US011636995B2

(12) United States Patent
Nonoguchi et al.

(10) Patent No.: US 11,636,995 B2
(45) Date of Patent: Apr. 25, 2023

(54) X-RAY GENERATION DEVICE AND X-RAY ANALYSIS APPARATUS

(71) Applicant: Rigaku Corporation, Akishima (JP)

(72) Inventors: Masahiro Nonoguchi, Akishima (JP); Masashi Kageyama, Akishima (JP)

(73) Assignee: RIGAKU CORPORATION, Tokyo (JP)

( * ) Notice: Subject to any disclaimer, the term of this patent is extended or adjusted under 35 U.S.C. 154(b) by 0 days.

(21) Appl. No.: 17/213,766

(22) Filed: Mar. 26, 2021

(65) Prior Publication Data

US 2021/0217574 A1 Jul. 15, 2021

Related U.S. Application Data

(63) Continuation of application No. PCT/JP2019/024573, filed on Jun. 20, 2019.

(30) Foreign Application Priority Data

Sep. 26, 2018 (JP) ..... JP2018-180385

(51) Int. Cl.
*H01J 35/14* (2006.01)
*H01J 35/24* (2006.01)
(Continued)

(52) U.S. Cl.
CPC ..... *H01J 35/153* (2019.05); *H01J 35/24* (2013.01); *H01J 35/101* (2013.01); *H01J 35/18* (2013.01); *H01J 35/26* (2013.01); *H01J 2235/162* (2013.01)

(58) Field of Classification Search
CPC ..... H01J 35/101; H01J 35/18; H01J 35/26; H01J 35/153; H01J 35/24; H01J 2235/162
See application file for complete search history.

(56) References Cited

U.S. PATENT DOCUMENTS 3,229,089 A * 1/1966 Sasao ..... G01N 23/043 378/124
3,646,379 A * 2/1972 Garewal ..... G21K 1/04 378/138
(Continued)

FOREIGN PATENT DOCUMENTS

JP 2007323964 A 12/2007
JP 2008269933 A 11/2008
(Continued)

OTHER PUBLICATIONS

International Search Report for International Application PCT/JP2019/024573; dated Sep. 10, 2019.

*Primary Examiner* — Chih-Cheng Kao
(74) *Attorney, Agent, or Firm* — Cantor Colburn LLP

(57) ABSTRACT

An X-ray generation device includes: a sealed X-ray tube including a cathode and an anode; a magnetic field generation portion applying a magnetic field to the electron beam, the magnetic field extending in a first direction, which crosses a traveling direction of the electron beam; and a rotary drive system configured to rotate the sealed X-ray tube, the anode having a surface including a first region and a second region arranged on one side and another side, with respect to a straight division line, the first region having a first metal arranged therein, and the second region having a second metal arranged therein, the second metal being different from the first metal, and by means of the rotary drive system rotating the sealed X-ray tube, the sealed X-ray tube being arranged with respect to the magnetic field generation portion so that the straight division line lies along the first direction.

7 Claims, 8 Drawing Sheets

(51) Int. Cl.

| | |
|---|---|
| *H01J 35/10* | (2006.01) |
| *H01J 35/18* | (2006.01) |
| *H01J 35/26* | (2006.01) |

(56) References Cited

U.S. PATENT DOCUMENTS

| | | | | |
|---|---|---|---|---|
| 2006/0050850 | A1* | 3/2006 | Andrews | H01J 35/16 378/119 |
| 2013/0136236 | A1* | 5/2013 | Morikawa | G01N 23/20 378/98.2 |
| 2017/0236678 | A1 | 8/2017 | Chaki et al. | |
| 2017/0236679 | A1 | 8/2017 | Chaki et al. | |

FOREIGN PATENT DOCUMENTS

| | | | |
|---|---|---|---|
| JP | 2010198778 | A | 9/2010 |
| WO | 2016039091 | A1 | 3/2016 |
| WO | 2016039092 | A1 | 3/2016 |

* cited by examiner

X-RAY GENERATION DEVICE AND X-RAY ANALYSIS APPARATUS

CROSS-REFERENCE TO PRIOR APPLICATIONS

This application is a continuation under 35 U.S.C. § 120 of PCT/JP2019/024573, filed Jun. 20, 2019, which is incorporated herein reference and which claimed priority to Japanese Application No. 2018-180385, filed Sep. 26, 2018. The present application likewise claims priority under 35 U.S.C. § 119 to Japanese Application No. 2018-180385, filed Sep. 26, 2018, the entire content of which is also incorporated herein by reference.

TECHNICAL FIELD

The present invention relates to an X-ray generation device including a sealed X-ray tube, and an X-ray analysis apparatus. The present invention relates to, in particular, technology for selectively generating X-rays having different wavelengths with a simple configuration.

BACKGROUND OF THE INVENTION

Hitherto, in X-ray analysis systems, in order to select one X-ray from a plurality of X-rays having different wavelengths for analysis, the following X-ray sources have been used. In a first X-ray source, a sealed X-ray tube is selectively placed. In a second X-ray source, a plurality of sealed X-ray tubes configured to generate X-rays having different wavelengths are arranged, and the plurality of sealed X-ray tubes are selectively driven. In a third X-ray source, a sealed X-ray tube includes two systems (two sets of a cathode and an anode), and one of the cathodes (filaments) to be heated (applied with a voltage) is selected to generate a desired X-ray (see JP 2007-323964 A). In a fourth X-ray source, an anode is a rotor target (rotating anticathode target), and a plurality of different metals are arranged on a surface of the rotor target, and are moved along an axis of rotation to select a metal to be irradiated, and hence to generate a desired X-ray (see JP 2008-269933 A, WO 2016/39091 A1 and WO 2016/039092 A1).

In recent years, in an X-ray analysis system, in addition to selecting one X-ray from a plurality of X-rays having different wavelengths for analysis, it is required to downsize the system, and it is desired to downsize a sealed X-ray tube to serve as an X-ray source.

In the above-mentioned first X-ray source, the used sealed X-ray tube itself that is used can be achieved with a simple configuration, but it is required to prepare a plurality of sealed X-ray tubes. In addition, each time one of the X-rays having different wavelengths is selected, the sealed X-ray tube must be replaced with a sealed X-ray tube configured to emit the X-ray having the corresponding wavelength, which leads to an increase in time required for measurement.

In the above-mentioned second X-ray source and the above-mentioned third X-ray source, focus positions of the X-rays having different wavelengths are different, and when the X-rays having different wavelengths are to have the same focus position, it is required to further include a movement control system. In the above-mentioned second X-ray source, it is required to move positions of the sealed X-ray tubes to adjust an optical axis of an X-ray. In the above-mentioned third X-ray source, a position of the sealed X-ray tube is moved to adjust a position of an anode of interest. In addition, in the second X-ray source and the third X-ray source, the apparatus is increased in size. In the second X-ray source, it is difficult to reduce a size of a focal point of a generation source.

In the above-mentioned fourth X-ray source, the apparatus is increased in size, and in addition, the structure is complicated, for example, it is required to cool the rotor target. Therefore, the fourth X-ray source is unsuitable for downsizing of the system and downsizing of the X-ray source.

BRIEF SUMMARY OF THE INVENTION

The invention disclosed in the present application in order to solve the above problems has various aspects, and the outline of typical ones of these aspects is as follows.

(1) In order to solve the above-mentioned problems, an X-ray generation device according to the present invention includes: a sealed X-ray tube including a cathode, from which thermoelectrons are emitted, and an anode which is irradiated with an electron beam which is obtained by accelerating the thermoelectrons using a potential difference applied between the cathode and the anode; a magnetic field generation portion arranged near the sealed X-ray tube to apply a magnetic field to the electron beam, the magnetic field extending in a first direction, which crosses a traveling direction of the electron beam; and a rotary drive system configured to rotate the sealed X-ray tube with respect to a center axis of the cathode and the anode, the anode having a surface including a first region and a second region, which are arranged on one side and another side, respectively, with respect to a straight division line passing through an intersection of the surface and the center axis, the first region having a first metal arranged therein, and the second region having a second metal arranged therein, the second metal being different from the first metal, by means of the rotary drive system rotating the sealed X-ray tube, when the sealed X-ray tube is driven, the sealed X-ray tube being arranged with respect to the magnetic field generation portion so that the straight division line lies along the first direction.

(2) In the X-ray generation device according to the above-mentioned item (1), the electron beam may have a cross section having an extended flat shape, and when the sealed X-ray tube is driven, the sealed X-ray tube may be arranged with respect to the magnetic field generation portion so that an extending direction of the extended flat shape lies along the first direction.

(3) In the X-ray generation device according to the above-mentioned item (1) or (2), the magnetic field generation portion may be a permanent magnet.

(4) In the X-ray generation device according to any one of the above-mentioned items (1) to (3), the surface of the anode may have a circular shape, and the intersection of the surface and the center axis may substantially coincide with a center of the circular shape.

(5) In the X-ray generation device according to any one of the above-mentioned items (1) to (4), the first direction may be substantially orthogonal to the traveling direction of the electron beam.

(6) In the X-ray generation device according to any one of the above-mentioned items (1) to (5), the sealed X-ray tube may include a first X-ray window and a second X-ray window, the first X-ray window being configured to allow an X-ray generated from a first irradiation region, in which the first metal arranged in the first region is irradiated with the electron beam, to pass therethrough, the second X-ray window being configured to allow an X-ray generated from a second irradiation region, in which the second metal arranged in the second region is irradiated with the electron beam, to pass therethrough.

(7) An X-ray analysis apparatus according to the present invention may include: the X-ray generation device of any one of the above-mentioned items (1) to (6); a support base configured to support a sample to be irradiated with an X-ray beam emitted from the X-ray generation device; and a detector configured to detect scattered X-rays generated from the sample.

DETAILED DESCRIPTION OF THE INVENTION

Figure 1:
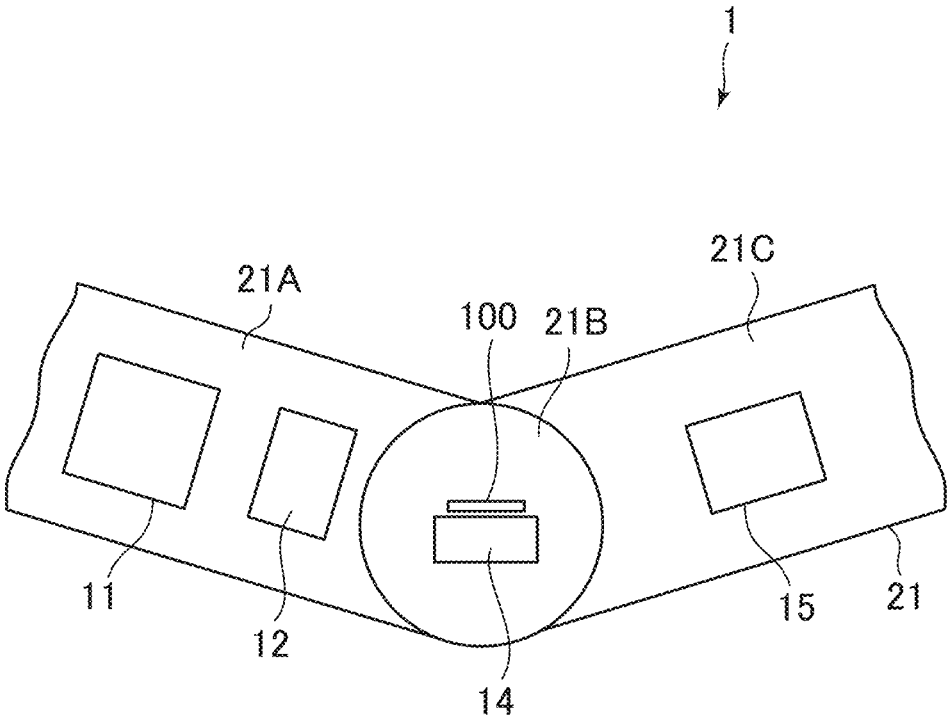
FIG. 1 is a schematic diagram for illustrating a configuration of an X-ray analysis apparatus according to an embodiment of the present invention.

Now, an embodiment of the present invention will be described with reference to the drawings. For clearer illustration, some sizes, shapes, and the like are schematically illustrated in the drawings in comparison to actual ones. However, the sizes, the shapes, and the like are merely an examples, and do not limit understanding of the present invention. Further, like elements to those described relating to the drawings already referred to are denoted by like reference symbols herein and in each of the drawings, and detailed description thereof is sometimes omitted as appropriate.

FIG. 1 is a schematic diagram for illustrating a configuration of an X-ray analysis apparatus 1 according to an embodiment of the present invention. In this example, the X-ray analysis apparatus 1 according to this embodiment is an X-ray diffraction measurement apparatus (XRD). However, without being limited thereto, the X-ray analysis apparatus 1 may be a small-angle X-ray scattering measurement apparatus (SAXS), or further, another X-ray analysis apparatus. The X-ray analysis apparatus 1 according to this embodiment includes an X-ray source portion 11, an optical system 12, a support base 14 configured to support a sample 100, a two-dimensional detector 15, and a goniometer 21.

The goniometer 21 is a horizontal sample mount θ-θ goniometer. The goniometer 21 includes an incident-side arm 21A, a fixing portion 21B, and a light-receiving-side arm 21C. The X-ray source portion 11 and the optical system 12 are arranged on the incident-side arm 21A, the support base 14 is arranged on the fixing portion 21B, and the two-dimensional detector 15 is mounted on the light-receiving-side arm 21C. The goniometer 21 can perform 20 scan while horizontally holding the sample 100 supported on the support base 14. Through horizontal mounting of the sample 100, the effect of distortion caused by the weight of the sample 100 itself can be minimized, and the risk of a dropping of the sample 100 can be suppressed. In the goniometer 21, when the fixing portion 21B (support base 14) is rotated by an angle of θ with respect to the incident-side arm 21A (X-ray source portion 11), the light-receiving-side arm 21C (two-dimensional detector 15) is rotated by an angle of 2θ with respect to the incident-side arm 21A.

The X-ray source portion 11 is an X-ray generation device according to this embodiment, and includes a sealed X-ray tube 31. Details of the X-ray source portion 11 will be described later. The optical system 12 is formed of, for example, one or more slits. The support base 14 configured to support the sample 100 is arranged (fixed) on the fixing portion 21B. X-rays generated from the X-ray source portion 11 are formed into a desired X-ray beam by the optical system 12, and the sample 100 supported by the support base 14 is irradiated with the X-ray beam.

The two-dimensional detector 15 is configured to detect scattered X-rays generated by the sample 100. The scattered X-rays include diffracted X-rays generated by the sample 100. Further, in this embodiment, the detector is not limited to the two-dimensional detector, and may be a one-dimensional detector. Still further, a light-receiving-side slit or other light-receiving-side optical system may be arranged between the support base 14 and the two-dimensional detector 15.

Figure 2A:
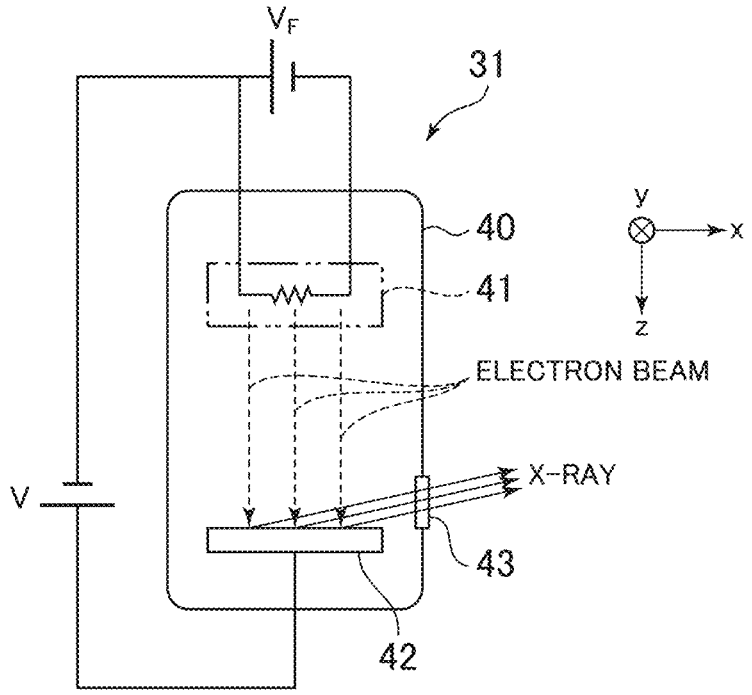
FIG. 2A is a view for illustrating a principle of a sealed X-ray tube in the embodiment of the present invention.

FIG. 2A is a view for illustrating a principle of the sealed X-ray tube 31 in this embodiment. The sealed X-ray tube 31 includes a vacuum tube 40, a cathode 41, an anode 42, and an X-ray window 43. The cathode 41 and the anode 42 are arranged inside the vacuum tube 40, the inside of which is maintained at a vacuum, and the X-ray window 43 is arranged in a side surface of the vacuum tube 40 (side surface of the sealed X-ray tube 31).

Figure 2B:
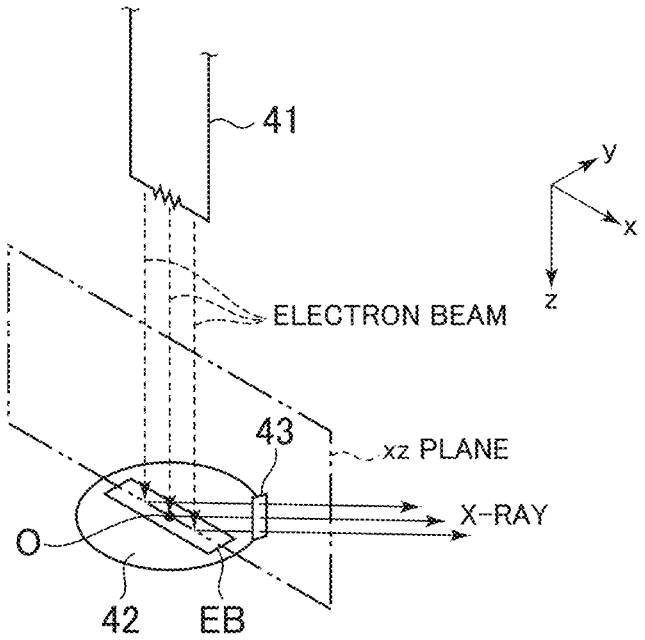
FIG. 2B is a view for illustrating an arrangement of a cathode and an anode of the sealed X-ray tube in the embodiment of the present invention.
Figure 2C:
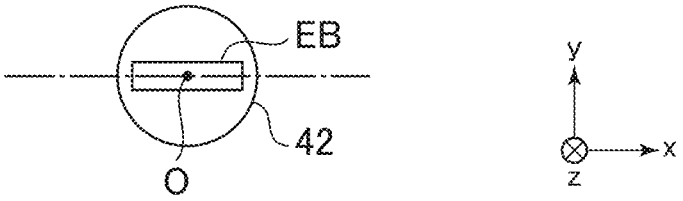
FIG. 2C is a plan view of the anode in the embodiment of the present invention.

FIG. 2B is a view for illustrating an arrangement of the cathode 41 and the anode 42 of the sealed X-ray tube 31 in this embodiment. FIG. 2B is a bird's eye view of a positional relationship between the cathode 41 and the anode 42. FIG. 2C is a plan view of the anode 42 in this embodiment.

The cathode 41 includes a filament. A potential difference VF of about several V is applied across both ends of the filament when driven. When the filament is heated to about 2,000° C., thermoelectrons are emitted by the cathode 41 (filament). When driven, a potential difference V of from several kV to several hundred kV is applied between the cathode 41 and the anode 42. In this embodiment, a distance between the cathode 41 and the anode 42 is about 6 mm, and the potential difference V to be applied between the cathode 41 and the anode 42 is about 30 kV. The thermoelectrons emitted by the cathode 41 are accelerated by the applied potential difference V, and the accelerated thermoelectrons form an electron beam, which is irradiated (smashed) on a surface of the anode 42. The filament of the cathode 41 has a linear shape, and the surface of the anode 42 has a circular shape. An irradiation region EB of the electron beam irradiated on the anode 42 has a linear shape (rectangular shape in which a longitudinal direction is significantly larger than a transverse direction, and which is hereinafter referred to as "long rectangular shape") to correspond to the filament shape of the cathode 41. In other words, the filament shape of the cathode 41 is the linear shape. With the potential difference V being applied between the cathode 41 and the anode 42, when the anode 42 is viewed from the cathode 41, an electric field in a region directly below the cathode is the strongest, and hence most electrons are accelerated directly downward along the electric field to form the electron beam, with which the irradiation region EB of the surface of the anode 42 is irradiated. In other words, a cross section of the electron beam has a flat shape (which is substantially a linear shape or long rectangular shape) extending along an extending direction of the linear shape of the filament. In each of FIG. 2A to FIG. 2C, x, y, and z axes are shown. The z axis is a traveling direction of the electron beam, and is parallel to a direction of the strongest electric field of electric fields generated between the cathode 41 and the anode 42. The x axis is the extending direction of the linear shape of the filament of the cathode 41. The y axis is a direction perpendicular to the x axis and the z axis.

When the electron beam is irradiated (smashed) onto the surface of the anode 42, the X-rays are generated. Of the X-rays generated in multiple directions, X-rays passing through the X-ray window 43 travel toward the optical system 12. In other words, the sealed X-ray tube 31 emits the X-rays from the X-ray window 43. The irradiation region EB of the electron beam has a flat shape (which is substantially a linear shape or long rectangular shape) extending in the x-axis direction to correspond to the linear shape of the filament of the cathode 41 and a flat shape of the cross section of the electron beam. The thermoelectrons emitted from the cathode 41 are accelerated by the applied potential difference V (electric fields generated between the cathode 41 and the anode 42). When viewed in plan view in the z-axis direction, the cathode 41 is superimposed to be included in the anode 42. Therefore, when the anode 42 is viewed from the cathode 41, the region directly below the cathode is an electric field in a negative z-axis direction, but electric fields around the region directly below the cathode have minute components (mainly y-axis component) in an xy plane. Therefore, the cross section of the electron beam spreads in the xy plane (mainly in the y-axis direction) gradually as the electron beam proceeds, compared to the linear shape of the filament of the cathode 41. Therefore, the irradiation region EB has a flat shape that spreads (mainly in the y-axis direction) compared to the linear shape of the filament of the cathode 41. In the present application, the traveling direction of the electron beam is defined as a direction (in this example, a z direction) of the strongest electric field of the electric fields generated between the cathode 41 and the anode 42.

In a plane (xz plane) which is orthogonal to a plane orthogonal to the surface (xy plane) of the anode 42, and which includes an extending direction (x axis) of the flat shape of the irradiation region EB, the X-ray window 43 is arranged on an extension in a direction crossing the surface of the anode 42 (or the extending direction of the flat shape of the irradiation region EB) at a certain angle. Through extraction of the X-ray beam in an oblique direction from the irradiation region EB having the flat shape, the irradiation region EB on the anode 42 can virtually serve as an X-ray source having a point shape. FIG. 2A to FIG. 2C show the principle of the sealed X-ray tube 31, and illustrate a driven state of the sealed X-ray tube 31 under a state in which a permanent magnet (described later) is not arranged near the sealed X-ray tube 31.

Figure 3A:
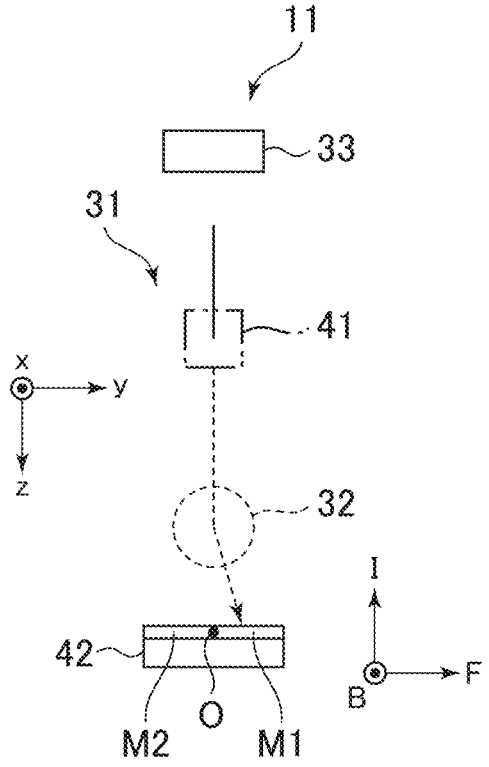
FIG. 3A is a schematic view for illustrating a configuration of an X-ray source portion in the embodiment of the present invention.
Figure 3B:
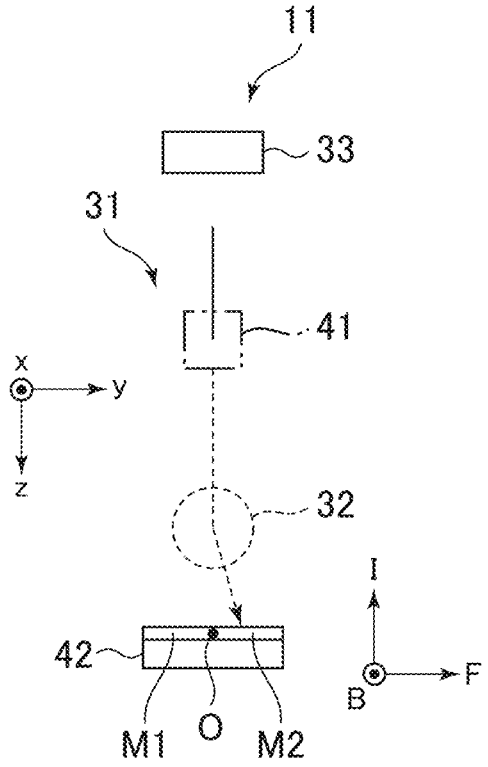
FIG. 3B is a schematic view for illustrating the configuration of the X-ray source portion in the embodiment of the present invention.
Figure 3C:
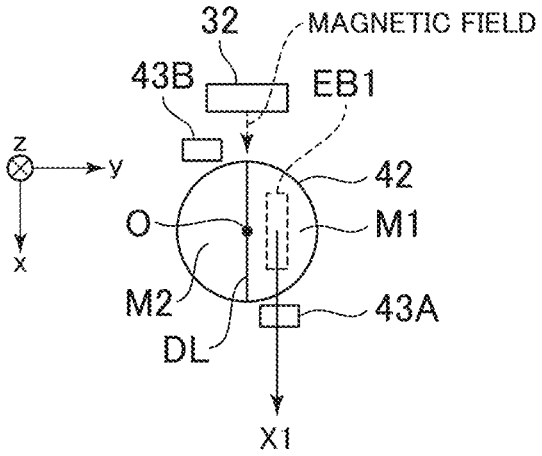
FIG. 3C is a schematic view for illustrating the configuration of the X-ray source portion in the embodiment of the present invention.
Figure 3D:
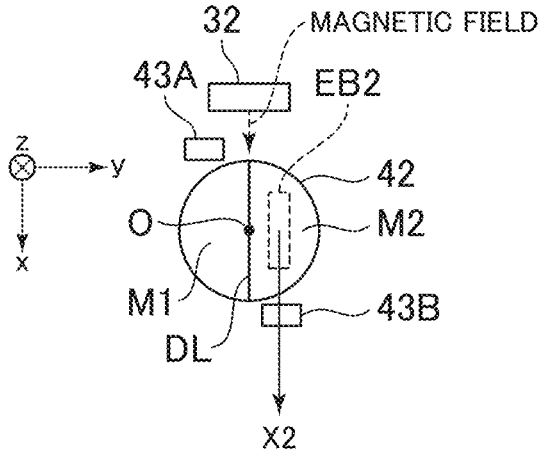
FIG. 3D is a schematic view for illustrating the configuration of the X-ray source portion in the embodiment of the present invention.

FIG. 3A to FIG. 3D are schematic views for illustrating a configuration of the X-ray source portion 11 in this embodiment. FIG. 3A shows a case of generating a first X-ray X1, and FIG. 3B shows a case of generating a second X-ray X2. FIG. 3C is a plan view of the anode 42 in the case of generating the first X-ray X1, and FIG. 3D is a plan view of the anode 42 in the case of generating the second X-ray X2. The X-ray source portion 11 includes the sealed X-ray tube 31, a permanent magnet 32, and a rotary drive system 33. The sealed X-ray tube 31 in this embodiment is an X-ray tube having a simple configuration such as illustrated in FIG. 2A, and does not include a component configured to electrically or magnetically control the electron beam between the cathode 41 and the anode 42. In other words, an alignment coil, a deforming & rotating coil, or a focusing coil, for example, is not arranged inside or outside the sealed X-ray tube 31.

The sealed X-ray tube 31 in this embodiment has the structure that is rotationally symmetrical with respect to a center axis of the cathode 41 and the anode 42. The "center axis of the cathode 41 and the anode 42" as used herein refers to a straight line connecting a center of the cathode 41 (midpoint of the linear shape of the filament) and a center of the anode 42 (center of the circular shape of the surface), and is parallel to the z-axis direction. The shape of the surface of the anode 42 is not limited to the circular shape, but also in such a case, the center axis of the cathode 41 and the anode 42 is a perpendicular drawn from the center of the cathode 41 to the anode 42. An outside diameter of the sealed X-ray tube 31 is 30 mm, and the anode 42 is a disc having an outside diameter of 10 mm and a thickness of 2 mm.

As illustrated in FIG. 3C and FIG. 3D, the surface of the anode 42 in this embodiment has the circular shape, but the surface of the anode 42 is divided with respect to a straight division line DL (in this example, diameter along the x-axis direction) passing through a center O. In this example, the center O is an intersection between the center axis of the cathode 41 and the anode 42, and the surface of the anode 42, and is the center of the circular shape of the surface of the anode 42. On the surface of the anode 42, a first region and a second region are arranged on one side (right side in FIG. 3C, and left side in FIG. 3D) and the other side (left side in FIG. 3C, and right side in FIG. 3D) of the straight division line DL, respectively. Further, a first metal M1 is arranged in the first region, and a second metal M2 is arranged in the second region. In this example, the first metal M1 and the second metal M2 are different metals. For example, the first metal M1 is tungsten (W), and the second metal M2 is copper (Cu). However, the present invention is not limited to this combination, and the first metal M1 and the second metal M2 may be any of two different metals that are suitable as the anode.

The permanent magnet 32 is arranged near the sealed X-ray tube 31. The permanent magnet 32 is a magnetic field generation portion in this embodiment. The permanent magnet 32 is arranged and fixed independently of the sealed X-ray tube 31 so as to apply, to the electron beam, a magnetic field extending in a first direction (in this example, the x-axis direction) crossing the traveling direction (in this example, the z-axis direction) of the electron beam. In this embodiment, it is desired that a surface on the sealed X-ray tube 31 side of the permanent magnet 32 be arranged at a position that is 15 mm to 18 mm away from the center axis of the cathode 41 and the anode 42, and the surface is arranged at a position that is 2.5 mm away from the side surface of the vacuum tube 40 (side surface of the sealed X-ray tube 31), for example. With the permanent magnet 32 applying the magnetic field extending in the first direction (in this example, positive x-axis direction) to the electron beam, a Lorentz force is applied to the electron beam in a direction (in this example, positive y-axis direction) perpendicular to a plane formed by the traveling direction of the electron beam and the direction (first direction) of the magnetic field to deflect the electron beam in the direction (in this example, positive y-axis direction). Therefore, the irradiation region in which the surface of the anode 42 is irradiated with the electron beam is moved in the direction (in this example, positive y-axis direction). In this embodiment, a deflection amount of the electron beam (distance by which the irradiation region is moved from the center O) is in a range of from 0.5 mm to 1 mm. The role of the permanent magnet 32 is the same as that of a deflection coil of an electromagnetic deflection cathode ray oscilloscope. However, unlike the deflection coil being formed of, for example, a four-pole coil, the electron beam can be deflected with a very simple configuration in which the permanent magnet 32 is arranged.

In this example, the permanent magnet 32 is a donut neodymium magnet having an outside diameter of 15 mmφ and an inside diameter of 10 mmφ. The magnetic field extends linearly from a center of the neodymium magnet. In other words, the magnetic field penetrating the electron beam from a center of the permanent magnet 32 (neodymium magnet) is in the positive x-axis direction. Magnetic fields around the magnetic field penetrating the electron beam from the center of the permanent magnet 32 have minute components spreading radially in a yz plane. Therefore, the magnetic field penetrating the electron beam is not uniform in the strict sense, but the minute components have substantially no effect on the deflection of the electron beam for the purpose of deflecting the electron beam. From that viewpoint, it can be regarded that the permanent magnet 32 applies, to the electron beam, the magnetic field extending in the first direction (positive x-axis direction). The permanent magnet 32 in this embodiment is the donut neodymium magnet, but may be a neodymium magnet having another shape, or a permanent magnet made of another material.

As illustrated in FIG. 3C and FIG. 3D, with the rotary drive system 33 rotating the sealed X-ray tube 31, the sealed X-ray tube 31 can be arranged at a desired rotational position when driven. Both in the case of generating the first X-ray X1, which is illustrated in FIG. 3A and FIG. 3C, and in the case of generating the second X-ray X2, which is illustrated in FIG. 3B and FIG. 3D, the sealed X-ray tube 31 is arranged with respect to the permanent magnet 32 so that, when driven, the straight division line DL of the anode 42 lies along the direction (first direction) of the magnetic field penetrating the electron beam. With this arrangement, the irradiation region in which the surface of the anode 42 is irradiated with the electron beam is a first irradiation region EB1, in which the first metal M1 is arranged, in the case of generating the first X-ray X1, and a second irradiation region EB2, in which the second metal M2 is arranged, in the case of generating the second X-ray X2. The first irradiation region EB1 and the second irradiation region EB2 substantially coincide in terms of position with respect to an external reference (for example, ground).

Further, it is desired that the first direction (direction of the magnetic field penetrating the electron beam) cross the traveling orientation of the electron beam at an angle of 85° or more and 90° or less (here, the orientation is supposed to be without directionality. An angle between the first direction and a traveling direction of the electron beam should be 85° or more and 95° or less), and it is more desired that the first direction be substantially orthogonal to the traveling direction of the electron beam. It is further desired that the sealed X-ray tube 31 be arranged with respect to the permanent magnet 32 so that an extending direction of the flat shape of the cross section of the electron beam lies along the first direction (direction of the magnetic field penetrating the electron beam). With this arrangement, the electron beam can be deflected along the transverse direction of the flat shape of the cross section of the electron beam. As a result, the first irradiation region EB1 and the second irradiation region EB2 can be easily moved to the region in which the first metal M1 is arranged and the region in which the second metal M2 is arranged, respectively. In this embodiment, the traveling direction of the electron beam is a positive z-axis direction, and the direction (first direction) of the magnetic field penetrating the electron beam is the positive x-axis direction. Further, the extending direction of the flat shape of the cross section of the electron beam is the x-axis direction, and the direction in which the electron beam is deflected by the magnetic field is the positive y-axis direction.

In the X-ray source portion 11 in this embodiment, by means of only the rotary drive system 33 rotating the sealed X-ray tube 31, the irradiation region in which the electron beam is irradiated can be set to the first irradiation region EB1, in which the first metal M1 is arranged, in the case of generating the first X-ray X1, and to the second irradiation region EB2, in which the second metal M2 is arranged, in the case of generating the second X-ray X2. The first irradiation region EB1 and the second irradiation region EB2 can be set to substantially coincide in terms of position with respect to the external reference (for example, ground), and the X-ray source can be set to the same position (focus position) as seen from the optical system 12. In other words, by means of only the driving of the rotary drive system 33, the X-ray source portion 11 can select any one of the first X-ray X1 and the second X-ray X2, and emit the selected X-ray to the optical system 12 under a common condition (with the same position of the X-ray source).

It is desired that the sealed X-ray tube 31 in this embodiment include a first X-ray window 43A and a second X-ray window 43B, the first X-ray window 43A being configured to allow the X-ray X1 generated from the first irradiation region EB1, in which the first metal M1 arranged in the first region is irradiated with the electron beam, to pass therethrough, the second X-ray window 43B being configured to allow the X-ray X2 generated from the second irradiation region EB2, in which the second metal M2 arranged in the second region is irradiated with the electron beam, to pass therethrough. Unlike the X-ray window 43 illustrated in FIG. 2B, which is arranged to allow the X-rays generated from the irradiation region EB to pass therethrough, the first irradiation region EB1 is moved in the positive y-axis direction from the center O when driven (see FIG. 3C), and the first X-ray window 43A is arranged, in the plane (xz plane) which is orthogonal to the plane orthogonal to the surface (xy plane) of the anode 42, and which includes the extending direction (x axis) of a flat shape of the first irradiation region EB1, on the extension in the direction crossing the surface of the anode 42 (or the extending direction of the flat shape of the first irradiation region EB1) at a predetermined angle, and in the side surface of the sealed X-ray tube 31 (side surface of the vacuum tube 40). Similarly, the second irradiation region EB2 is moved in the positive y-axis direction from the center O when driven (see FIG. 3D), and the second X-ray window 43B is arranged, in the plane (xz plane) which is orthogonal to the plane orthogonal to the surface (xy plane) of the anode 42, and which includes an extending direction (x axis) of a flat shape of the second irradiation region EB2, on the extension in the direction crossing the surface of the anode 42 (or the extending direction of the flat shape of the second irradiation region EB2) at the predetermined angle, and in the side surface of the sealed X-ray tube 31. Therefore, the first X-ray window 43A and the second X-ray window 43B are arranged to be rotationally symmetrical (by 180°) with respect to the center axis of the cathode 41 and the anode 42 (and point symmetrical in the xy plane). With the sealed X-ray tube 31 in this embodiment including the first X-ray window 43A and the second X-ray window 43B, the selected X-ray can be emitted to the optical system 12 under the identical geometric condition (with the same position of the X-ray source).

Therefore, the X-ray generation device according to this embodiment can generate X-rays having different wavelengths without replacing the X-ray tube (sealed X-ray tube). In order to select one of the X-rays having different wavelengths, it is only required that the sealed X-ray tube be rotated by 180° by the rotary drive system. Further, with the magnetic field generation portion being fixed with respect to the sealed X-ray tube, a magnitude of the magnetic field penetrating the electron beam is constant, the deflection amount of the electron beam is constant, and the irradiation region in which the surface of the anode is irradiated with the electron beam is independent from the rotation of the sealed X-ray tube, thus stay at constant position. With the sealed X-ray tube including the first X-ray window and the second X-ray window, irrespective of which one of the X-rays having different wavelengths is selected, the X-ray beam can be extracted to the outside under the identical radiation conditions.

Alternative Embodiment 1

An X-ray generation device according to Alternative embodiment 1 of the present invention will now be described. In the X-ray generation device according to the embodiment of the present invention, while the rotary drive system 33 rotates the sealed X-ray tube 31, the permanent magnet 32 is fixed independently of the sealed X-ray tube 31. In contrast, the X-ray generation device according to Alternative embodiment 1 is different in that, while the rotary drive system 33 rotates the permanent magnet 32, the sealed X-ray tube 31 is fixed independently of the permanent magnet 32. Accompanying this, the X-ray generation device according to Alternative embodiment 1 is different from the embodiment of the present invention in that the X-ray window 43, through which both of the X-ray X1 generated from the first irradiation region EB1 and the X-ray X2 generated from the second irradiation region EB2 are allowed to pass, is arranged in the side surface of the sealed X-ray tube 31. However, the X-ray generation device according to Alternative embodiment 1 is the same as the generator according to the embodiment of the present invention in all other respects.

Figure 4A:
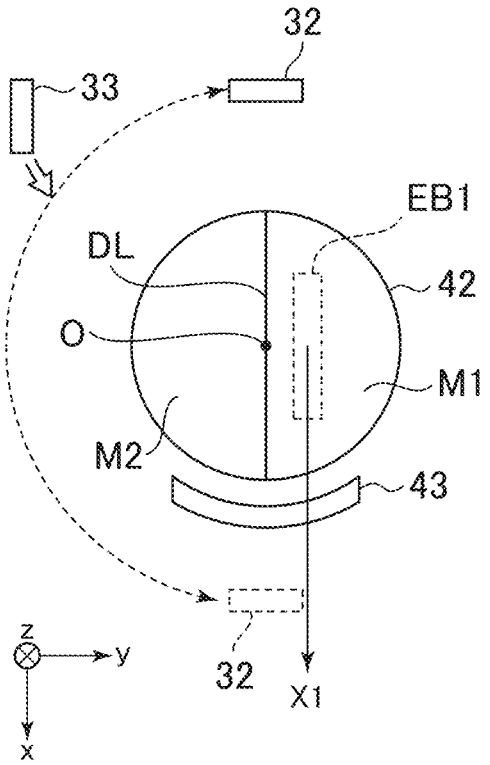
FIG. 4A is a schematic view for illustrating a configuration of an X-ray source portion in Alternative embodiment 1.
Figure 4B:
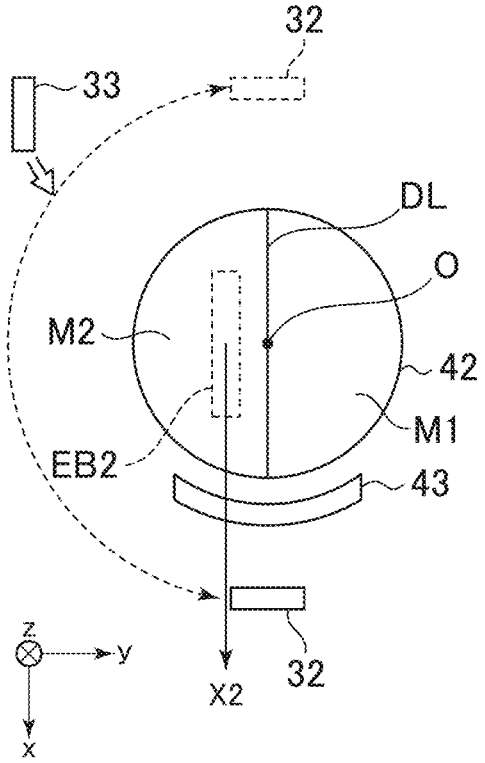
FIG. 4B is a schematic view for illustrating the configuration of the X-ray source portion in Alternative embodiment 1.

FIG. 4A and FIG. 4B are schematic views for illustrating a configuration of the X-ray source portion 11 in Alternative embodiment 1. FIG. 4A and FIG. 4B correspond to FIG. 3C and FIG. 3D, respectively, in which FIG. 4A is a plan view of the anode 42 in the case of generating the first X-ray X1, and FIG. 4B is a plan view of the anode 42 in the case of generating the second X-ray X2. In the case of generating the first X-ray X1, with the rotary drive system 33 rotating the permanent magnet 32, as illustrated in FIG. 4A, the permanent magnet 32 is arranged on a negative x-axis direction side of the anode 42 to apply a magnetic field penetrating the electron beam in the positive x-axis direction. Therefore, a Lorentz force is applied in the positive y-axis direction to deflect the electron beam in the positive y-axis direction, and to move the first irradiation region EB1 in the positive y-axis direction from the center O. In the case of generating the second X-ray X2, with the rotary drive system 33 rotating the permanent magnet 32, as illustrated in FIG. 4B, the permanent magnet 32 is arranged on the positive x-axis direction side of the anode 42 to apply a magnetic field penetrating the electron beam in a negative x-axis direction. Therefore, a Lorentz force is applied in a negative y-axis direction to deflect the electron beam in the negative y-axis direction, and to move the second irradiation region EB2 in the negative y-axis direction from the center O.

The sealed X-ray tube 31 in Alternative embodiment 1 includes the X-ray window 43, through which both of the X-ray X1 generated from the first irradiation region EB1 and the X-ray X2 generated from the second irradiation region EB2 are allowed to pass, and which is arranged in the side surface of the sealed X-ray tube 31. The X-ray window 43 allows light paths of the following two X-ray beams to pass therethrough. The first is a light path that is, in the plane (xz plane) which is orthogonal to the plane orthogonal to the surface (xy plane) of the anode 42, and which includes the extending direction (x axis) of the flat shape of the first irradiation region EB1, an extension line in a direction crossing the surface of the anode 42 (or the extending direction of the flat shape of the first irradiation region EB1) at a predetermined angle. The second is a light path that is, in the plane (xz plane) which is orthogonal to the plane orthogonal to the surface (xy plane) of the anode 42, and which includes the extending direction (x axis) of the flat shape of the second irradiation region EB2, an extension line in a direction crossing the surface of the anode 42 (or the extending direction of the flat shape of the second irradiation region EB2) at a predetermined angle. With the sealed X-ray tube 31 in Alternative embodiment 1 including the X-ray window 43, any X-ray having the selected wavelength can be emitted to the optical system 12 with a simple configuration. Unlike the embodiment of the present invention, the position of the X-ray source is shifted along the y-axis direction between the case of generating the first X-ray X1 and the case of generating the second X-ray X2. However, the shift along the y-axis direction between the first irradiation region EB1 and the second irradiation region EB2 is at a level in a range of from 1 mm to 2 mm, and the X-ray generation device according to Alternative embodiment 1 is optimal for measurement in which the shift does not present a problem.

Alternative Embodiment 2

An X-ray generation device according to Alternative embodiment 2 of the present invention will be described. In the X-ray generation device according to Alternative embodiment 1, the rotary drive system 33 rotates the permanent magnet 32 to reverse the orientation of a magnetic field penetrating the electron beam. In contrast, the X-ray generation device according to Alternative embodiment 2 is different in that the rotary drive system 33 is not included, and that a first permanent magnet 32A and a second permanent magnet 32B are arranged instead to be rotationally symmetrical (by) 180° with respect to the center axis of the cathode 41 and the anode 42 (and point symmetrical with respect to the center O in the xy plane). Accompanying this, the X-ray generation device according to Alternative embodiment 2 is different from Alternative embodiment 1 in that a first antimagnetic shutter 35A is arranged between the first permanent magnet 32A and the sealed X-ray tube 31, and in that a second antimagnetic shutter 35B is arranged between the second permanent magnet 32B and the sealed X-ray tube 31, but is the same as the X-ray generation device according to Alternative embodiment 1 in all other respects. When the shutter is open, the first antimagnetic shutter 35A/second antimagnetic shutter 35B allows, a magnetic field generated by the first permanent magnet 32A/second permanent magnet 32B to pass therethrough so that the first permanent magnet 32A/second permanent magnet 32B can apply the magnetic field penetrating the electron beam. In contrast when the shutter is closed, the first antimagnetic shutter 35A/second antimagnetic shutter 35B blocks, the magnetic field generated by the first permanent magnet 32A/second permanent magnet 32B so that the first permanent magnet 32A/second permanent magnet 32B cannot apply the magnetic field penetrating the electron beam.

Figure 5A:
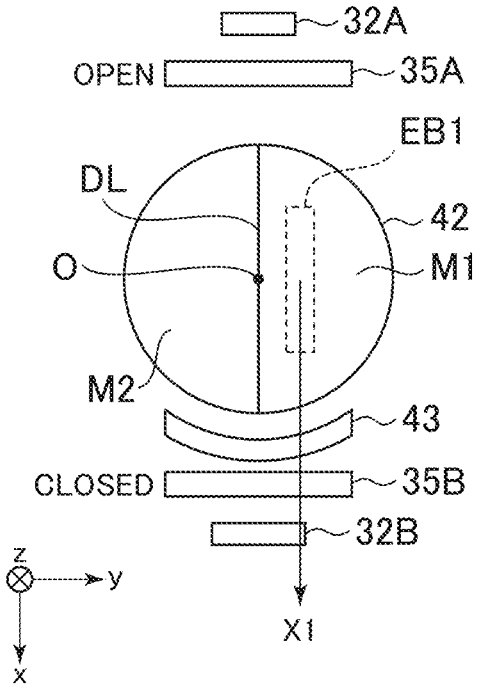
FIG. 5A is a schematic view for illustrating a configuration of an X-ray source portion in Alternative embodiment 2.
Figure 5B:
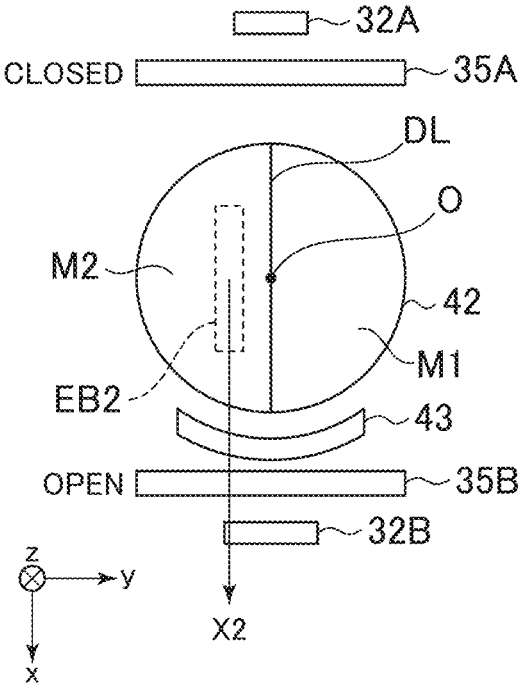
FIG. 5B is a schematic view for illustrating the configuration of the X-ray source portion in Alternative embodiment 2.

FIG. 5A and FIG. 5B are schematic views for illustrating a configuration of the X-ray source portion 11 in Alternative embodiment 2. FIG. 5A and FIG. 5B correspond to FIG. 4A and FIG. 4B, respectively, in which FIG. 5A is a plan view of the anode 42 in the case of generating the first X-ray X1, and FIG. 5B is a plan view of the anode 42 in the case of generating the second X-ray X2. In the X-ray source portion 11 in Alternative embodiment 2, the first antimagnetic shutter 35A and the first permanent magnet 32A are arranged in the stated order on the negative x-axis direction side of the anode 42, and the second antimagnetic shutter 35B and the second permanent magnet 32B are arranged in the stated order on the positive x-axis direction side of the anode 42. The X-ray source portion 11 in Alternative embodiment 2 does not include the rotary drive system 33.

As illustrated in FIG. 5A, in order to generate the first X-ray X1, the first antimagnetic shutter 35A is opened, and the second antimagnetic shutter 35B is closed so that the first permanent magnet 32A applies a magnetic field penetrating the electron beam in the positive x-axis direction. Therefore, as in Alternative embodiment 1, the first irradiation region EB1 is moved in the positive y-axis direction from the center O. As illustrated in FIG. 5B, in order to generate the second X-ray X2, the second antimagnetic shutter 35B is opened, and the first antimagnetic shutter 35A is closed so that the second permanent magnet 32B applies a magnetic field penetrating the electron beam in the negative x-axis direction. Therefore, as in Alternative embodiment 1, the second irradiation region EB2 is moved in the negative y-axis direction from the center O. The sealed X-ray tube 31 in Alternative embodiment 2 includes the same X-ray window 43 as in Alternative embodiment 1. With this configuration, any X-ray having the selected wavelength can be emitted to the optical system 12 with a simple configuration.

Alternative Embodiment 3

An X-ray generation device according to Alternative embodiment 3 of the present invention will now be described. In the X-ray generation device according to Alternative embodiment 2, the first antimagnetic shutter 35A/second antimagnetic shutter 35B, and the first permanent magnet 32A/second permanent magnet 32B are arranged on both sides of the anode 42. In contrast, the X-ray generation device according to Alternative embodiment 3 is different in that an antimagnetic shutter 35 and the permanent magnet 32 are arranged only on one side of the anode 42. Accompanying this, the position of the second irradiation region EB2 is different from the embodiment of the present invention and Alternative embodiments 1 and 2. Therefore, the first region and the second region on the surface of the anode 42 are different. Further, the arrangement of the X-ray window 43 is different from Alternative embodiments 1 and 2. The X-ray generation device according to Alternative embodiment 3 has the same structure as that in Alternative embodiment 2 otherwise.

Figure 6A:
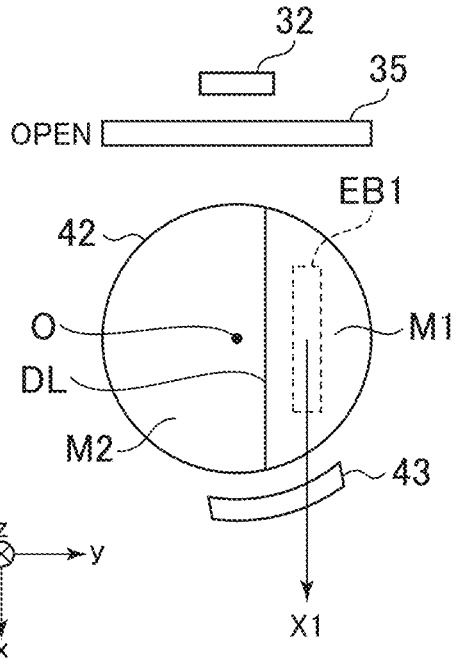
FIG. 6A is a schematic view for illustrating a configuration of an X-ray source portion in Alternative embodiment 3.
Figure 6B:
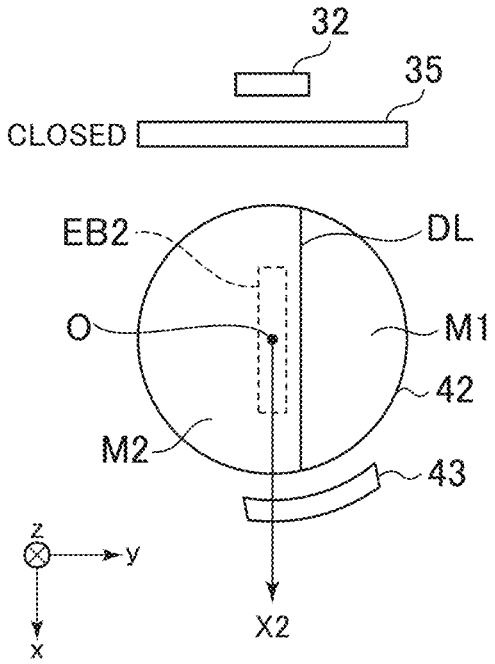
FIG. 6B is a schematic view for illustrating the configuration of the X-ray source portion in Alternative embodiment 3.

FIG. 6A and FIG. 6B are schematic views for illustrating a configuration of the X-ray source portion 11 in Alternative embodiment 3. FIG. 6A and FIG. 6B correspond to FIG. 4A and FIG. 4B showing the anode 42 in Alternative embodiment 1, and to FIG. 5A and FIG. 5B showing the anode 42 in Alternative embodiment 2, respectively, in which FIG. 6A is a plan view of the anode 42 in the case of generating the first X-ray X1, and FIG. 6B is a plan view of the anode 42 in the case of generating the second X-ray X2. In the X-ray source portion 11 in Alternative embodiment 3, the antimagnetic shutter 35 and the permanent magnet 32 are arranged in the stated order on the negative x-axis direction side of the anode 42. The X-ray source portion 11 in Alternative embodiment 3 does not include the rotary drive system 33.

As illustrated in FIG. 6A, in order to generate the first X-ray X1, the antimagnetic shutter 35 is opened so that the permanent magnet 32 applies a magnetic field penetrating the electron beam in the positive x-axis direction. Therefore, as in Alternative embodiments 1 and 2, the first irradiation region EB1 is moved in the positive y-axis direction from the center O. As illustrated in FIG. 6B, in order to generate the second X-ray X2, the antimagnetic shutter 35 is closed so that the permanent magnet 32 does not apply a magnetic field to the electron beam. Therefore, unlike Alternative embodiments 1 and 2, the second irradiation region EB2 is not deflected with respect to the center O, and the flat shape of the second irradiation region EB2 penetrates the center O. The second irradiation region EB2 coincides with the irradiation region EB illustrated in FIG. 2C. In other words, the X-ray source portion 11 in Alternative embodiment 3 is different from Alternative embodiments 1 and 2 in that the straight division line DL is moved in the positive y-axis direction from the center O, and in the first region in which the first metal M1 is arranged and the second region in which the second metal M2 is arranged.

The sealed X-ray tube 31 in Alternative embodiment 3 includes the X-ray window 43, through which both of the X-ray X1 generated from the first irradiation region EB1 and the X-ray X2 generated from the second irradiation region EB2 are allowed to pass, and which is arranged in the side surface of the sealed X-ray tube 31. The X-ray window 43 allows light paths of the following two X-ray beams to pass therethrough. As in Alternative embodiments 1 and 2, the first is a light path that is, in the plane (xz plane) which is orthogonal to the plane orthogonal to the surface (xy plane) of the anode 42, and which includes the extending direction (x axis) of the flat shape of the first irradiation region EB1, an extension line in a direction crossing the surface of the anode 42 (or the extending direction of the flat shape of the first irradiation region EB1) at a predetermined angle. The second is a light path that is, in the plane (xz plane) which is orthogonal to the plane orthogonal to the surface (xy plane) of the anode 42, and which includes the extending direction (x axis) of the flat shape of the second irradiation region EB2, an extension line in a direction crossing the surface of the anode 42 (or the extending direction of the flat shape of the second irradiation region EB2) at a predetermined angle. In this example, the second irradiation region EB2 penetrates the center O.

With the sealed X-ray tube 31 in Alternative embodiment 3 including the X-ray window 43, any X-ray having the selected wavelength can be emitted to the optical system 12 with a simple configuration. As in Alternative embodiments 1 and 2, the position of the X-ray source is shifted along the y-axis direction between the case of generating the first X-ray X1 and the case of generating the second X-ray X2. However, the shift along the y-axis direction between the first irradiation region EB1 and the second irradiation region EB2 is at a level in a range of from 0.5 mm to 1 mm, and the X-ray generation device according to Alternative embodiment 3 is optimal for measurement in which the shift does not present a problem. The straight division line DL of the anode 42 in Alternative embodiment 3 does not penetrate the center O, and is moved in the positive y-axis direction. The first region in which the first metal M1 is arranged is narrower as compared to those in Alternative embodiments 1 and 2, and the second region in which the second metal M2 is arranged is wider as compared to those in Alternative embodiments 1 and 2.

In the X-ray generation device according to Alternative embodiment 3, the center of the cathode 41 is arranged above the center O of the anode 42, but the present invention is not limited thereto. For example, the cathode 41 may be arranged to be moved in the negative y-axis direction from the center O of the anode 42 as viewed in plan view so that a center line between the first irradiation region EB1 and the second irradiation region EB2 penetrates the center O. In this case, it is desired that the straight division line DL penetrate the center O as in Alternative embodiments 1 and 2.

The X-ray generation device and the X-ray analysis apparatus according to the embodiment of the present invention have been described along with Alternative embodiments 1 to 3. The present invention and Alternative embodiments 1 to 3 are widely applicable without being limited to the above-mentioned embodiment. For example, the magnetic field generation portion in the above-mentioned embodiment, for example, is the permanent magnet 32. However, the magnetic field generation portion is not limited thereto, and may be an electromagnetic coil. Further, the straight division line DL of the anode 42 is the center line between the first irradiation region EB1 and the second irradiation region EB2, but the present invention is not limited thereto. It is only required that the first region include the first irradiation region EB1, that the first metal M1 be arranged in at least the first irradiation region EB1, that the second region include the second irradiation region EB2, and that the second metal M2 be arranged in at least the second irradiation region EB2.

Further, in the above-mentioned embodiment, for example, the X-ray window is arranged so that the X-ray beam is extracted in the oblique direction in the plane which includes the extending direction of the irradiation region having the flat shape and which is perpendicular to the surface of the anode, and hence the X-ray generation device virtually serves as the X-ray source having the point shape. However, the present invention is not limited thereto. For example, through arrangement of an X-ray window having a length corresponding to a length in the extending direction of the irradiation region in the direction which is perpendicular to the extending direction of the flat shape of the irradiation region and which forms a predetermined angle with the surface of the anode, the X-ray generation device may serve as an X-ray source having a linear shape.

The invention claimed is:

1. An X-ray generation device, comprising:

a sealed X-ray tube including a cathode, from which thermoelectrons are emitted, and an anode which is irradiated with an electron beam which is obtained by accelerating the thermoelectrons with a potential difference applied between the cathode and the anode;

a magnetic field generation portion arranged near the sealed X-ray tube to apply a magnetic field to the electron beam, the magnetic field extending in a first direction, which crosses a traveling direction of the electron beam; and a rotary drive system configured to rotate the sealed X-ray tube with respect to a center axis of the cathode and the anode and configured to halt a rotation of the sealed X-ray tube during a generation of an X-ray, the anode having a surface consisting of a first region and a second region, which are arranged on one side and a remaining side in a plane perpendicular to the center axis, respectively, with respect to a straight division line passing through an intersection of the surface and the center axis, the first region only having a first metal arranged therein, and the second region only having a second metal arranged therein, the second metal being different from the first metal, by means of the rotary drive system rotating the sealed X-ray tube, when the sealed X-ray tube is driven, the sealed X-ray tube being arranged with respect to the magnetic field generation portion so that the straight division line lies along the first direction.

2. The X-ray generation device according to claim 1, wherein the electron beam has a cross section having an extended flat shape, and wherein, when the sealed X-ray tube is driven, the sealed X-ray tube is arranged with respect to the magnetic field generation portion so that an extending direction of the extended flat shape lies along the first direction.

3. The X-ray generation device according to claim 1, wherein the magnetic field generation portion is a permanent magnet.

4. The X-ray generation device according to claim 1, wherein the surface of the anode has a circular shape, and the intersection of the surface and the center axis substantially coincides with a center of the circular shape.

5. The X-ray generation device according to claim 1, wherein the first direction is substantially orthogonal to the traveling direction of the electron beam.

6. The X-ray generation device according to claim 1, wherein the sealed X-ray tube includes a first X-ray window and a second X-ray window, the first X-ray window being configured to allow an X-ray generated from a first irradiation region, in which the first metal arranged in the first region is irradiated with the electron beam, to pass therethrough, the second X-ray window being configured to allow an X-ray generated from a second irradiation region, in which the second metal arranged in the second region is irradiated with the electron beam, to pass therethrough.

7. An X-ray analysis apparatus, comprising:

the X-ray generation device of claim 1;

a support base configured to support a sample to be irradiated with an X-ray beam emitted from the X-ray generation device; and a detector configured to detect scattered X-rays generated from the sample.

* * * * *